US007431276B2

(12) United States Patent
Morimoto

(10) Patent No.: US 7,431,276 B2
(45) Date of Patent: Oct. 7, 2008

(54) BINDING APPARATUS FOR PRINTED SHEETS

(75) Inventor: Taketsugu Morimoto, Ibaraki (JP)

(73) Assignee: Gunze Limited, Ayabe-shi, Kyoto (JP)

( * ) Notice: Subject to any disclaimer, the term of this patent is extended or adjusted under 35 U.S.C. 154(b) by 295 days.

(21) Appl. No.: 10/558,700

(22) PCT Filed: Jun. 19, 2003

(86) PCT No.: PCT/JP03/07835

§ 371 (c)(1),
(2), (4) Date: Nov. 30, 2005

(87) PCT Pub. No.: WO2004/113213

PCT Pub. Date: Dec. 29, 2004

(65) Prior Publication Data

US 2006/0249892 A1 Nov. 9, 2006

(51) Int. Cl.
*B65H 37/04* (2006.01)

(52) U.S. Cl. ..... 270/52.18; 270/52.14; 270/52.16; 270/58.08

(58) Field of Classification Search ..... 270/52.14, 270/52.16, 52.18, 58.08; 271/280, 285
See application file for complete search history.

(56) References Cited

U.S. PATENT DOCUMENTS

| | | | | |
|---|---|---|---|---|
| 3,744,649 | A | 7/1973 | Ward | |
| 4,072,060 | A * | 2/1978 | Kitai et al. | 73/863.41 |
| 5,195,741 | A * | 3/1993 | Stauber | 271/303 |
| 5,893,559 | A * | 4/1999 | Takahashi et al. | 271/280 |

FOREIGN PATENT DOCUMENTS

| | | | |
|---|---|---|---|
| JP | 6-255865 | A | 9/1994 |
| JP | 8-5179 | Y2 | 2/1996 |
| JP | 2000-118511 | A | 4/2000 |
| JP | 2001-19260 | A | 1/2001 |
| JP | 2003095215 | A * | 4/2003 |

* cited by examiner

*Primary Examiner*—Gene O. Crawford
*Assistant Examiner*—Leslie Nicholson, III
(74) *Attorney, Agent, or Firm*—Birch, Stewart, Kolasch & Birch, LLP

(57) ABSTRACT

A binding apparatus for printed sheets includes a carrying-in conveyor part; a reverse conveyor part contiguous to the carrying-in conveyor part; an accumulating part; and a binding part. A branch part and a holding part are provided at a junction of an upper conveyor and a lower conveyor of the reverse conveyor part so as to provide the functions of taking out non-defective printed sheets and defective printed sheets and eliminating a space at a junction of the upper conveyor and the lower conveyor, thereby simplifying the conveyor device.

2 Claims, 5 Drawing Sheets

BINDING APPARATUS FOR PRINTED SHEETS

TECHNICAL FIELD

The present invention relates to a binding apparatus for printed sheets.

BACKGROUND ART

There is a publicly known binding apparatus for printed sheets, described in, for example, JP-A-2000-118511 and JP-A-2001-19260.

The conventional binding apparatus for printed sheets comprises a carrying-in conveyor part that sets printed sheets in a planar manner on a conveyance surface of a carrying conveyor to positionally shift the printed sheets in a direction of conveyance so that leading edges thereof in the direction of conveyance can be seen from above, and conveys the printed sheets in succession in a transverse direction, a reverse conveyor part contiguous to the carrying-in conveyor part to convey the printed sheets upward from the transverse direction and convey the same downward in a direction opposed to the transverse direction, an accumulating part that sets the printed sheets in upright position at a terminal end of the reverse conveyor part to arrange and accumulate the same in the transverse direction, and a binding part that binds the printed sheets thus accumulated.

The reverse conveyor part includes an upper conveyor and a lower conveyor divided vertically in a portion thereof, in which the printed sheets are conveyed upward, and a branch part is provided at a terminal end of the lower conveyor to discharge the printed sheets from the conveyor. The branch part serves for taking out non-defective printed sheets.

Further, the carrying-in conveyor part is provided with a dam-up part (a device forming a space between printed sheets and printed sheets, which are conveyed in succession), and a dam-up eliminating part (a device eliminating a space between printed sheets and printed sheets so as to convey printed sheets in succession) is provided at a junction of the carrying-in conveyor part and the reverse conveyor part. A defective product taking-out part is provided on the dam-up eliminating part.

Since three devices, that is, the dam-up eliminating part, the defective product taking-out part, and the branch part for taking-out of non-defective products are provided separately in the conventional binding apparatus, the conveyor is complicated in construction.

Accordingly, it is an object of the invention to provide a binding apparatus for printed sheets, in which such three devices are united into one to make a conveyor simple in construction.

DISCLOSURE OF THE INVENTION

In order to attain the object, the invention adopts the following measures. That is, a binding apparatus for printed sheets, according to the invention, includes a carrying-in conveyor part that sets printed sheets in a planar manner on a conveyance surface of a carrying conveyor to positionally shift the printed sheets in a direction of conveyance so that leading edges thereof in the direction of conveyance can be seen from above, and conveys the printed sheets in succession in a transverse direction; a reverse conveyor part contiguous to the carrying-in conveyor part to convey the printed sheets upward from the transverse direction and convey the printed sheets downward in a direction opposed to the transverse direction; an accumulating part that sets the printed sheets in upright position at a terminal end of the reverse conveyor part to arrange and accumulate the same in the transverse direction; and a binding part that binds the printed sheets thus accumulated. The reverse conveyor part includes an upper conveyor and a lower conveyor divided vertically in a portion thereof, in which the printed sheets are conveyed upward.

A branch part is provided at a terminal end of the lower conveyor to discharge the printed sheets from the conveyor. A holding part is provided at a start end of the upper conveyor to hold a trailing end of the printed sheets held by the conveyor in a predetermined position.

By adopting the above construction, the invention provides three functions of taking out a non-defective product, taking out a defective product, and eliminating a space at a junction of the upper conveyor and the lower conveyor, thereby simplifying the conveyor device.

In the invention, the lower conveyor includes a lower inside conveyor and a lower outside conveyor for interposing the printed sheets therebetween from both front and back sides of the sheets, and the upper conveyor includes an upper inside conveyor and an upper outside conveyor for interposing the printed sheets therebetween from both front and back sides of the sheets. The branch part includes, at a terminal end of the lower outside conveyor, a branch conveyor which is outwardly foldable to release the printed sheets from an interposed state, and a branch guide which guides the printed sheets from inside so as to make the sheets follow the outward folding of the branch conveyor. Further, a control unit is provided to stop conveyance of the upper conveyor when the branch conveyor is outwardly folded, and the holding part includes a pushing device for moving a trailing end of those printed sheets, which are held by the stopped upper conveyor, outward from inside, and a holding device for holding the trailing end of the printed sheets thus pushed out, from outside.

Also, in the invention, the pushing device includes a push-up bar arranged in a position to connect between conveyance surfaces of the upper and lower inside conveyors, and push-up bar drive means for outwardly moving the push-up bar, and the holding device includes a holding bar pivotally provided for holding a trailing end of the printed sheets from underneath, and holding-bar drive means for vertically swinging the holding bar.

In a case that a space is formed between printed sheets, the control unit eliminates such space by stopping the upper conveyor when a trailing end of a printed sheet in a preceding group adjacent to the space reaches the branch part, causing the holding part to hold the trailing end, and releasing stoppage of the upper conveyor when the front of a succeeding group reaches the branch part.

BEST MODE FOR CARRYING OUT THE INVENTION

An embodiment of the invention will be described below with reference to the drawings.

Figure 1:
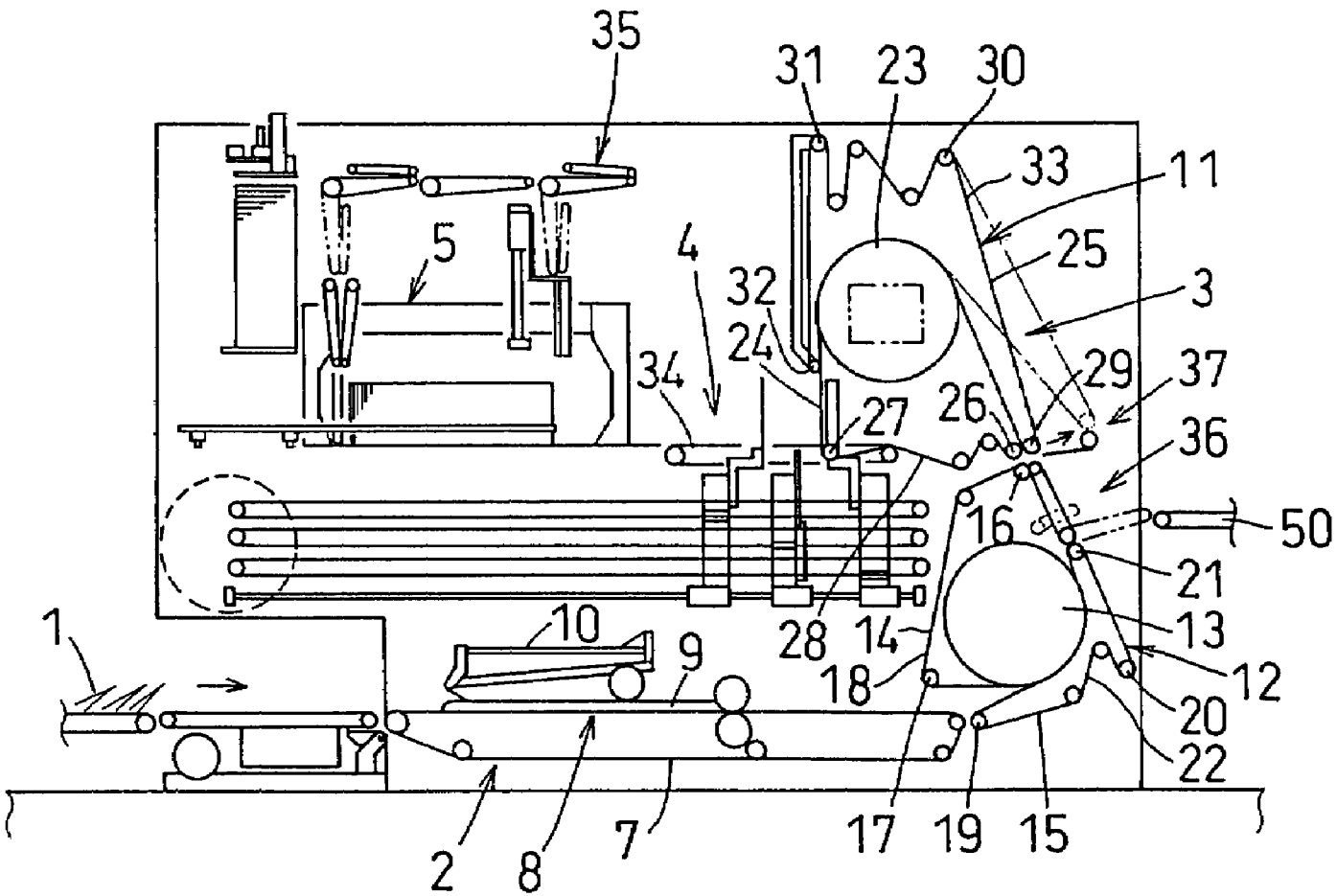
FIG. 1 is a front view showing an embodiment of a binding apparatus for printed sheets according to the invention.
Figure 2:
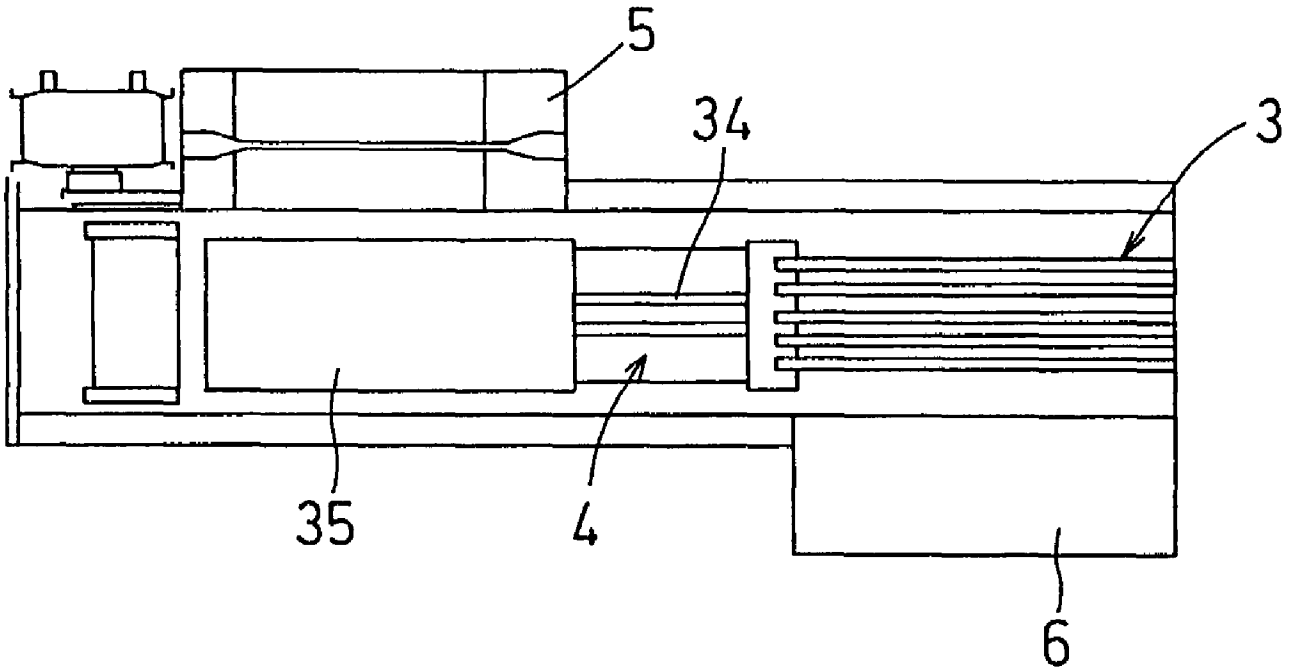
FIG. 2 is a front view corresponding to FIG. 1.

FIGS. 1 and 2 show a binding apparatus for printed sheets according to the invention.

As shown in FIG. 1, the binding apparatus comprises a carrying-in conveyor part 2, a reverse conveyor part 3, an accumulating part 4, and a binding part 5 which are arranged in a direction of conveyance of printed sheets 1, and a control unit 6 that controls these parts.

The carrying-in conveyor part 2 serves as an intake of the printed sheets 1 fed from a rotary press machine (not shown) or the like. The carrying-in conveyor part 2 comprises an endless belt 7 with a conveying surface arranged horizontal. The endless belt 7 comprises a plurality of band-shaped belts. The carrying-in conveyor part 2 sets the printed sheets 1 on the conveying surface of the belt 7 in a planar manner to successively convey the same in a transverse direction in a manner to shift positions thereof in the direction of conveyance so that leading edges thereof in the direction of conveyance can be seen from above.

In this embodiment, the transverse direction means a right to left direction in FIG. 1. Also, the printed sheets 1 are folded double (double-folded) and conveyed with the folds oriented forward.

The carrying-in conveyor part 2 is provided with a dam-up part 8.

The dam-up part 8 has substantially the same principle of operation as that described in JP-UM-B-8-5179.

With regard to the dam-up part 8, an elevating base 9 ascends and a main stopper 10 descends, so that the printed sheets 1 conveyed on the belt 7 are held therebetween to stop the flow of the printed sheets and a space (dam-up) is formed between the printed sheets 1 and the printed sheets 1 in the direction of conveyance. A detailed explanation is quoted from the JP-UM-B-8-5179.

The reverse conveyor part 3 is connected to the carrying-in conveyor part 2 to convey the printed sheets 1 upward from the transverse direction and convey the same downward in a direction opposed to the transverse direction. A portion of the reverse conveyor part 3, in which the printed sheets 1 are conveyed upward, is divided vertically into an upper conveyor 11 and a lower conveyor 12.

The lower conveyor 12 includes a large-diameter lower drum 13 arranged in a region, in which a course of conveyance is changed upward from the transverse direction. Also, the lower conveyor 12 comprises a lower inside conveyor 14 and a lower outside conveyor 15, between which the printed sheets 1 are interposed from both front and back sides thereof.

The lower inside conveyor 14 includes a first roller 16 arranged above the lower drum 13, a second roller 17 arranged on the left side of the lower drum 13, and an endless belt 18 wrapped around outer peripheries of the first roller 16, the second roller 17, and the lower drum 13. The endless belt 18 comprises a plurality of band-shaped belts.

The lower outside conveyor 15 includes a third roller 19 arranged rightwardly downwardly of the lower drum 13, a fourth roller 20 arranged on the right side of the lower drum 13, a fifth roller 21 arranged beneath the first roller 16, and an endless belt 22 wrapped around the third to fifth rollers 19, 20, 21 and arranged along an outer surface side of a portion of the lower inside conveyor, which is wrapped around the lower drum 13. The endless belt 22 comprises a plurality of band-shaped belts.

The upper conveyor 11 includes a large-diameter upper drum 23 arranged in a region in which a course is changed downward from above. Further, the upper conveyor 11 includes an upper inside conveyor 24 and an upper outside conveyor 25, which interpose the printed sheets 1 therebetween from both front and back sides of the sheets.

The upper inside conveyor 24 includes a sixth roller 26 arranged above the first roller 16 and a seventh roller 27 arranged beneath the upper drum 23 and in the vicinity of a right, vertical tangent of the upper drum 23, and an endless belt 28 wrapped around outer peripheries of the sixth and seventh rollers 26, 27 and the upper drum 23.

The upper outside conveyor 25 includes an eighth roller 29 arranged in the vicinity of the sixth roller 26, a ninth roller 30 arranged rightwardly and upwardly of the upper drum 23, a tenth roller 31 arranged leftwardly and upwardly of the upper drum 23, an eleventh roller 32 arranged leftwardly and downwardly of the upper drum 23, and an endless belt 33 wrapped around the eighth to eleventh rollers 29, 30, 31, 32 and arranged along an outer surface side of the endless belt 28 wrapped around the upper drum 23 of the upper inside conveyor 24. The endless belts 28, 33 both comprise a plurality of band-shaped belts.

The upper and lower drums 23, 13 are arranged such that the upper drum 23 is not arranged just above the lower drum 13 but the upper drum 23 is arranged in a position shifted rightwardly of the lower drum 13. That is, an upwardly conveying portion of the reverse conveyor part 3 does not convey the printed sheets 1 just above but is inclined leftward from the right in FIG. 1. Also, a downwardly conveying portion is oriented to be vertical.

The upper conveyor 11 and the lower conveyor 12 each include a drive unit, illustration of which is omitted. The drive units can be operated independently by the control unit 6.

The accumulating part 4 sets the printed sheets 1 side by side to transversely accumulate the same in upright position at a terminal end of the reverse conveyor part 3. The double-folded printed sheets 1 are accumulated in the accumulating part 4 with folds thereof positioned below. The printed sheets 1 in upright position are accumulated on a transverse feed conveyor 34, and a conveyance surface of the transverse feed conveyor 34 moves leftward in FIG. 1 whereby the printed sheets 1 in upright position are accumulated over a predetermined length in the transverse direction to form an accumulated body of printed sheets. A filler paper cord feed device 35 is provided to feed filler paper cords to front and rear sides of the accumulated body of printed sheets.

As shown in FIG. 2, the binding part 5 is arranged laterally of the accumulating part 4. In the binding part 5, a string is corded on the accumulated body of printed sheets to bind the same.

Constructions of the respective parts of the binding apparatus described above are substantially the same as those described in JP-A-2000-118511, which is referred to for a detailed explanation of the constructions.

Figure 3:
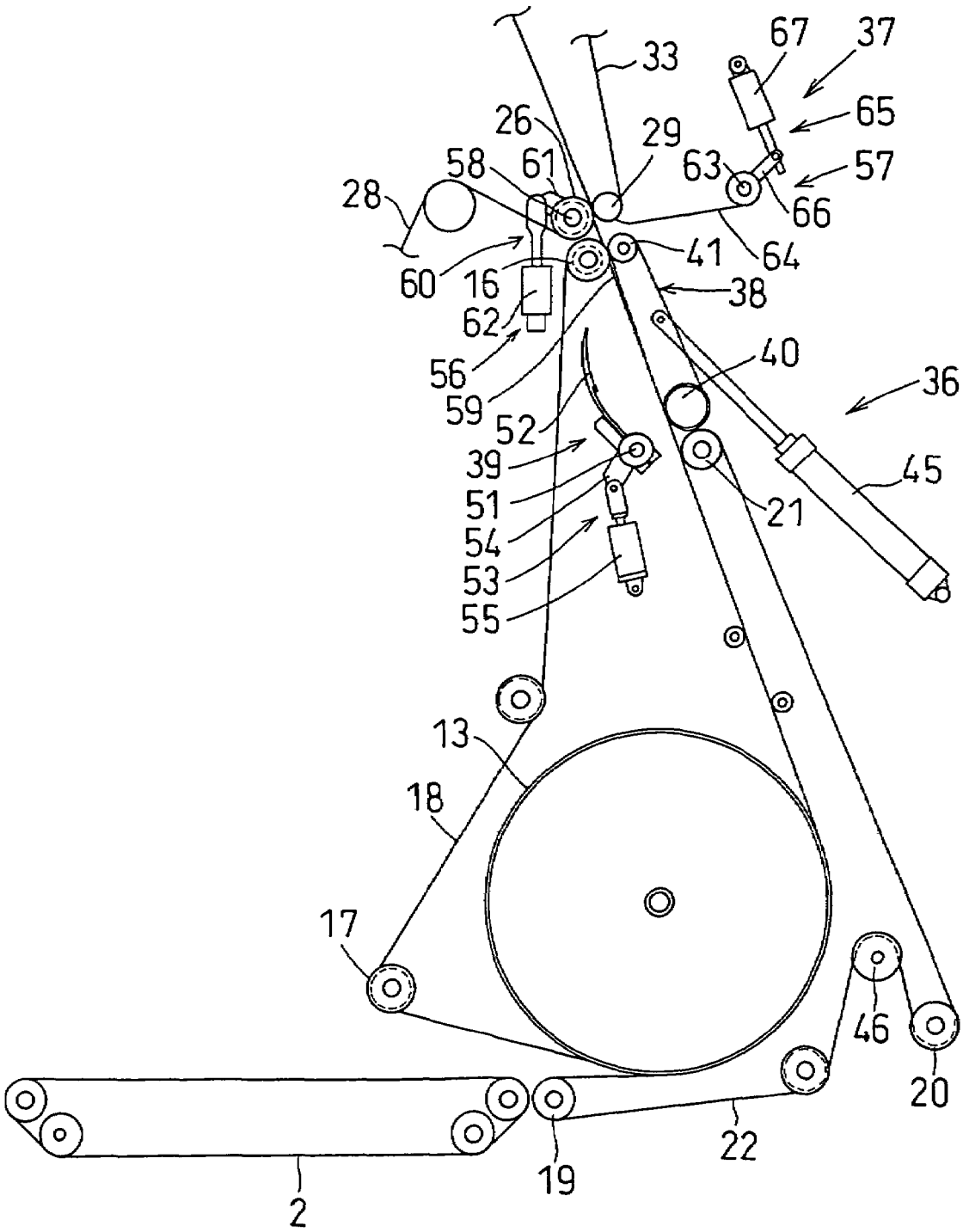
FIG. 3 is an enlarged, front view showing a conveyor device in the invention.
Figure 4:
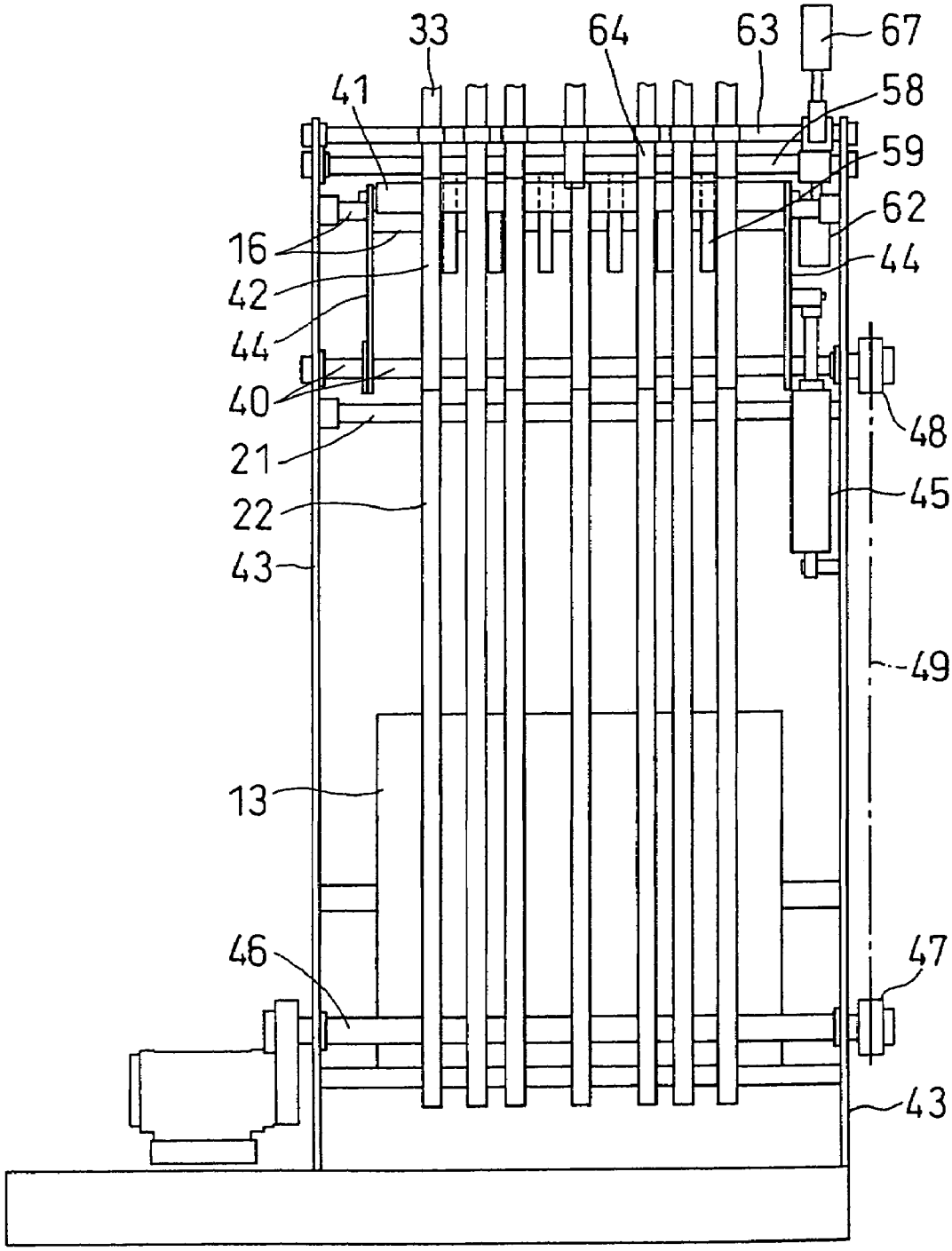
FIG. 4 is a side view showing the conveyor device shown in FIG. 3.

As shown in FIGS. 3 and 4, a branch part 36 is provided at a terminal end of the lower conveyor 12 to discharge the printed sheets 1 from the lower conveyor 12. Further, a holding part 37 is provided at a start end of the upper conveyor 11 to hold a trailing end of the printed sheets 1 held by the upper conveyor 11 in a predetermined position.

The branch part 36 includes, at a terminal end of the lower outside conveyor 15, a branch conveyor 38 which is outwardly foldable to release the printed sheets 1 from a held state, and a branch guide 39 which guides the printed sheets 1 from inside so as to make the sheets follow the outward folding of the branch conveyor 38.

The branch conveyor 38 includes a twelfth roller 40 arranged above and in proximity to the fifth roller 21 at the terminal end of the lower outside conveyor 15, and a thirteenth roller 41 arranged on the right side of the first roller 16, and an endless belt 42 is wrapped around the twelfth and thirteenth rollers 40, 41. The endless belt 42 comprises a plurality of band-shaped belts.

As shown in FIG. 4, the first to fifth rollers 16, 17, 19, 20, 21 and the lower drum 13 are rotatably supported by a pair of left and right main frames 43. The twelfth roller 40 of the branch conveyor 38 is also rotatably supported by the main frames 43. A pair of left and right swing frames 44 are supported inside the main frames 43 and on both left and right sides of the twelfth roller 40. The thirteenth roller 41 is supported at tip ends of the swing frames 44.

Drive means 45 is provided to swing the swing frames 44 about an axis of the twelfth roller 40. The drive means 45 comprises a first cylinder provided between the swing frame 44 and the main frame 43. A telescopic motion of the cylinder 45 causes an upper end of the swing frames 44 to swing rightward in FIG. 3 about the axis of the twelfth roller 40. That is, the branch conveyor 38 is folded substantially 90° outward from a position in which a conveyance surface thereof contacts with a conveyance surface of the lower inside conveyor 14, thereby releasing such contact.

The lower outside conveyor 15 has a drive shaft 46, and one end of the drive shaft 46 is joined to a drive device and provided at the other end thereof with a transmission pulley 47. The twelfth roller 40 is also provided at a shaft end thereof with a driven pulley 48, and transmission means 49 interlockingly connects the driven pulley 48 and the transmission pulley 47.

A carrying-out conveyor 50 connected to the branch conveyor 38 is provided in a position in which the branch conveyor 38 is folded outward about 90° (see FIG. 1).

The branch guide 39 includes a first turning shaft 51 supported by the left and right main frames 43, the first turning shaft 51 being disposed inside the lower conveyor 12, and a plurality of fork-shaped guide pieces 52 are fixed to the first turning shaft 51. The guide pieces 52 are positioned within clearances between each of the plurality of endless belts 18 of the lower inside conveyor 14. Drive means 53 is provided to cause the guide pieces 52 to outwardly project. The drive means 53 comprises an arm 54 fixed to an end of the first turning shaft 51, and a second cylinder 55 provided between the arm 54 and the main frame 43. A telescopic motion of the second cylinder 55 turns the first turning shaft 51, thereby enabling the guide pieces 52 fixed to the first turning shaft 51 to pass through the clearances between the endless belts 18 to project outward from inside the lower conveyor 12. The guide pieces 52 are formed to be arcuate-shaped, and when projecting outward, the guide pieces outwardly guide the printed sheets 1 conveyed on the lower conveyor 12.

The first cylinder 45 and the second cylinder 55 are synchronized in motion by the control unit 6 such that when the branch conveyor 38 is folded outward, the branch guide 39 followingly projects outward, and when the branch conveyor returns to its original position, the branch guide follows that motion.

Further, the control unit 6 is configured to stop conveyance by the upper conveyor 11 when the branch conveyor 38 is folded outward.

The holding part 37 includes a pushing device 56 that moves a trailing end of the printed sheets 1, which are held by the stopped upper conveyor 11, outward from inside, and a holding device 57 that holds the trailing end of the printed sheets 1 thus pushed out, from outside.

The pushing device 56 includes a second turning shaft 58 supported by the left and right main frames 43. The sixth roller 26 is provided on the second turning shaft 58 to be able to idle. The sixth roller 26 is axially divided to include predetermined axial spacings and arranged on the second turning shaft 58 to correspond in number to the endless belts 28 of the upper inside conveyor 24. Push-up bars 59 are fixed to the second turning shaft 58 to be positioned between the divided portions of the sixth roller 26. The push-up bars 59 are arranged in a position to connect between the conveyance surface of the lower inside conveyor 14 and a conveyance surface of the upper inside conveyor 24. Push-up bar drive means 60 is provided to move the push-up bars 59 outward. The drive means 60 comprises an arm 61 fixed to an end of the second turning shaft 58, and a third cylinder 62 arranged between the arm 61 and the main frame 43. A telescopic motion of the third cylinder 62 causes the push-up bars 59 to swing outward to move the trailing end of the printed sheets 1, which are held by the upper conveyor 11, outward from inside.

The holding device 57 includes a third turning shaft 63 supported by the left and right main frames 43. A holding bar 64 is fixed to the turning shaft 63. The holding bar 64 is arranged axially offset from the push-up bars 59 so as not to interfere therewith. Holding-bar drive means 65 is provided to swing the holding bar 64 vertically. The drive means 65 comprises an arm 66 provided at an end of the third turning shaft 63, and a fourth cylinder 67 arranged between the arm 66 and the main frame 43. A telescopic motion of the fourth cylinder 67 causes the holding bar 64 to hold the trailing end of the printed sheets 1 from underneath.

Further, when a space in the direction of conveyance is formed between printed sheets 1 and printed sheets 1, in order to eliminate such space, the control unit 6 stops the upper conveyor 11 when a trailing end of a printed sheet 1 in a preceding group adjacent to the space reaches the branch part 36, causes the holding part 37 to hold the trailing end, and releases the stoppage of the upper conveyor 11 when the front of a following group reaches the branch part 36. In order to perform such control, the binding apparatus according to the invention is provided with detection means (illustration of which is omitted) that detects a space between printed sheets and printed sheets.

An operation of the binding apparatus, according to the invention, constructed in the above manner will be described with reference to FIG. 5.

Normal operations of binding are the same as those described in JP-A-2000-118511, which is referred to for a detailed explanation of the normal operation.

First, an explanation will be given to an operation of taking out non-defective printed sheets or defective printed sheets in the course of printed sheets 1 being conveyed in succession.

For taking out non-defective printed sheets or defective printed sheets from a conveyance line, the control unit 6 issues a taking-out command. According to this command, the branch conveyor 38 and the branch guide 39, which are indicated by solid lines, in the branch part 36 are folded outward as indicated by imaginary lines in ① of FIG. 5. The conveyance direction of the printed sheets 1 having been conveyed upward by the lower inside conveyor 14 is changed to horizontally rightward by the branch guide 39 projecting from the conveyance surface, thereby placing the sheets on the branch conveyor 38 indicated by imaginary lines and taking outside the line by the carrying-out conveyor 50 connected to the branch conveyor 38.

When the branch conveyor 38 is folded outward, conveyance by the upper conveyor 11 is stopped by the control unit 6. Accordingly, a trailing end of the printed sheets 1 held between the upper inside conveyor 24 and the upper outside conveyor 25 is retained in a hanging state at a terminal end of the upper conveyor 11.

Figure 5:
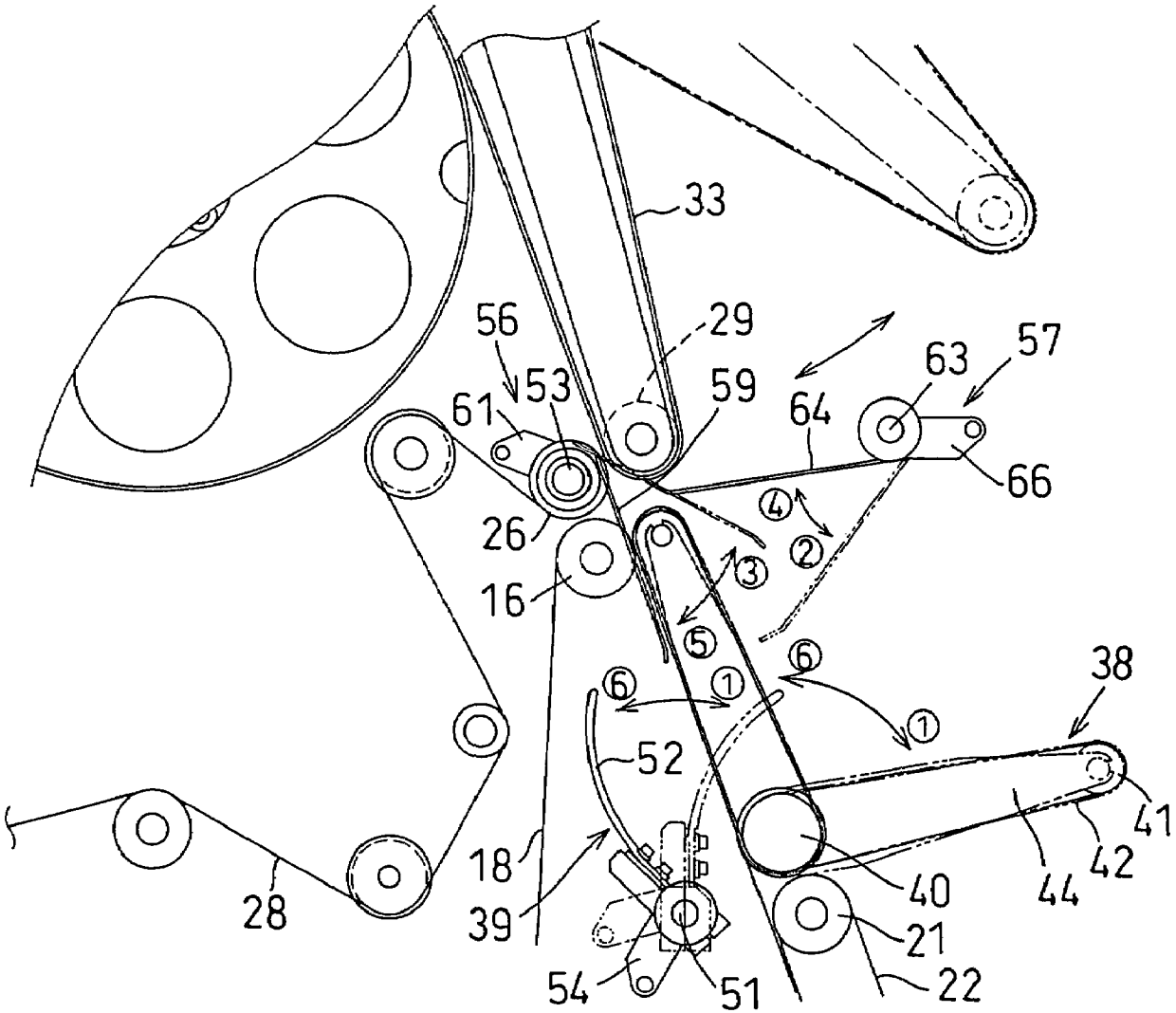
FIG. 5 is a view illustrating an operation of the conveyor device.

In the holding part 37, after the branch conveyor 38 is folded outward, the holding bar 64 and the push-up bars 59, which are indicated by solid lines, are moved in the order indicated by ② and ③ in FIG. 5 to positions indicated by imaginary lines. That is, the movement of the push-up bars 59 pushes up the trailing end of the printed sheets 1 to a position indicated by ③.

Subsequently, the holding bar 64 returns to a position indicated by ④ to hold the trailing end of the printed sheets 1. Thereafter, the push-up bars 59 return to each original position indicated by ⑤.

When a command of canceling the taking-out operation is issued, the branch conveyor 38 and the branch guide 39 return to each original position indicated by ⑥ Upon such return, taking-out operation of the printed sheets 1, which are conveyed by the lower conveyor 12, from the carrying-out conveyor 50 is terminated, and the printed sheets 1 are conveyed to the upper conveyor 11.

At this time, driving of the upper conveyor 11 having been stopped is started immediately before the front of the printed sheets 1 being conveyed by the lower conveyor 12 reaches the terminal end of the upper conveyor 11. This driving of the upper conveyor 11 enables a trailing end of printed sheets 1 having been held at the terminal end thereof to be overlapped an upper surface of succeeding printed sheets 1 to be conveyed in succession.

If a trailing end of printed sheets 1 were not held above the conveyance surface by the holding device 57 but abut against the conveyance surface, it is uncertain whether the front of succeeding printed sheets 1 is overlapped on an underside of the trailing end or on an upper side of the trailing end. According to the invention, however, a normal state of conveyance is surely maintained.

Subsequently, an explanation will be given to an operation of eliminating an unexpected space possibly generated between printed sheets 1 and printed sheets 1 in a state of continuous conveyance so as to obtain a successive conveyance state.

In a case that such space is detected by detection means, illustration of which is omitted, the branch part 36 performs a motion of ① in FIG. 5 and the holding part 37 performs motions of ② to ⑤ when a trailing end of a preceding group adjacent to the space reaches the holding part 37. Thus the preceding group is held by the upper conveyor 11 as stopped, and the trailing end of printed sheets 1 is held above the conveyance surface by the holding bar 64.

When the front of a succeeding group reaches the holding part 37, the branch part 36 performs a motion of ⑥ and driving of the upper conveyor 11 is started, whereby the front of the succeeding group normally follows the trailing end of the preceding group to be conveyed in succession.

As described above, according to the invention, the branch part 36 and the holding part 37 are provided at a junction of the upper conveyor 11 and the lower conveyor 12 of the reverse conveyor part 3 so as to provide the function of taking out non-defective printed sheets 1 and defective printed sheets 1 and eliminating a space, thereby simplifying the present apparatus in construction as compared with conventional ones.

It should be noted that the invention is not limited to the above embodiment.

INDUSTRIAL APPLICABILITY

The invention is utilized in book binding industries, leaflet printing industries, or the like.

The invention claimed is:

1. A binding apparatus for printed sheets, comprising:

a carrying-in conveyor part that sets printed sheets in a planar manner on a conveyance surface of a carrying conveyor to positionally shift the printed sheets in a direction of conveyance so that leading edges thereof in the direction of conveyance can be seen from above, and conveys the printed sheets in succession in a transverse direction;

a reverse conveyor part contiguous to the carrying-in conveyor part to convey the printed sheets upward from the transverse direction and convey the printed sheets downward in a direction opposed to the transverse direction;

an accumulating part that sets the printed sheets in upright position at a terminal end of the reverse conveyor part to arrange and accumulate the same in the transverse direction; and a binding part that binds the printed sheets thus accumulated, wherein the reverse conveyor part includes an upper conveyor and a lower conveyor divided vertically in a portion thereof in which the printed sheets are conveyed upward, the lower conveyor having a branch part provided at a terminal end thereof to discharge the printed sheets from the conveyor, the upper conveyor having a holding part provided at a start end thereof to hold a trailing end of the printed sheets held by the conveyor in a predetermined position, wherein the lower conveyor comprises a lower inside conveyor and a lower outside conveyor for interposing the printed sheets therebetween from both front and back sides of the sheets, while the upper conveyor comprises an upper inside conveyor and an upper outside conveyor for interposing the printed sheets therebetween from both front and back sides of the sheets, the branch part comprises, at a terminal end of the lower outside conveyor, a branch conveyor which is outwardly foldable to release the printed sheets from an interposed state, and a branch guide which guides the printed sheets from inside so as to make the sheets follow the outward folding of the branch conveyor, a control unit is provided to stop conveyance of the upper conveyor when the branch conveyor is outwardly folded, and the holding part comprises a pushing device for moving a trailing end of the printed sheets, which are held by the stopped upper conveyor, outward from inside, and a holding device for holding the trailing end of the printed sheets thus pushed out, from outside, and wherein the pushing device comprises a push-up bar arranged in a position to connect between conveyance surfaces of the upper and lower inside conveyors, and push-up bar drive means for outwardly moving the push-up bar, and the holding device comprises a holding bar pivotally provided for holding a wailing end of the printed sheets from underneath, and holding-bar drive means for vertically swinging the holding bar.

2. A binding apparatus for printed sheets, comprising:

a carrying-in conveyor part that sets printed sheets in a planar manner on a conveyance surface of a carrying conveyor to positionally shift the printed sheets in a direction of conveyance so that leading edges thereof in the direction of conveyance can be seen from above, and conveys the printed sheets in succession in a transverse direction;

a reverse conveyor part contiguous to the carrying-in conveyor part to convey the printed sheets upward from the transverse direction and convey the printed sheets downward in a direction opposed to the transverse direction;

an accumulating part that sets the printed sheets in upright position at a terminal end of the reverse conveyor part to arrange and accumulate the same in the transverse direction; and a binding part that binds the printed sheets thus accumulated, wherein the reverse conveyor part includes an upper conveyor and a lower conveyor divided vertically in a portion thereof in which the printed sheets are conveyed upward, the lower conveyor having a branch part provided at a terminal end thereof to discharge the printed sheets from the conveyor, the upper conveyor having a holding part provided at a start end thereof to hold a trailing end of the printed sheets held by the conveyor in a predetermined position, wherein the lower conveyor comprises a lower inside conveyor and a lower outside conveyor for interposing the printed sheets therebetween from both front and back sides of the sheets, while the upper conveyor comprises an upper inside conveyor and an upper outside conveyor for interposing the printed sheets therebetween from both front and back sides of the sheets, the branch part comprises, at a terminal end of the lower outside conveyor, a branch conveyor which is outwardly foldable to release the printed sheets from an interposed state, and a branch guide which guides the printed sheets from inside so as to make the sheets follow the outward folding of the branch conveyor, a control unit is provided to stop conveyance of the upper conveyor when the branch conveyor is outwardly folded, and the holding part comprises a pushing device for moving a trailing end of the printed sheets, which are held by the stopped upper conveyor, outward from inside, and a holding device for holding the trailing end of the printed sheets thus pushed out, from outside, wherein the pushing device comprises a push-up bar arranged in a position to connect between conveyance surfaces of the upper and lower inside conveyors, and push-up bar drive means for outwardly moving the push-up bar, and the holding device comprises a holding bar pivotally provided for holding a trailing end of the printed sheets from underneath, and holding-bar drive means for vertically swinging the holding bar, and wherein in a case that a space is formed between printed sheets and printed sheets, the control unit eliminates such space by stopping the upper conveyor when a trailing end of a printed sheet in a preceding group adjacent to the space reaches the branch part, causing the holding part to hold the trailing end, and releasing the stoppage of the upper conveyor when the front of a succeeding group reaches the branch part.

* * * * *